US006715268B2

(12) United States Patent
Hill et al.

(10) Patent No.: US 6,715,268 B2
(45) Date of Patent: Apr. 6, 2004

(54) CARD PACKAGE PRODUCTION SYSTEM WITH CARD PACKAGE STACKER AND METHOD

(75) Inventors: Jeffery L. Hill, Mundelein, IL (US); Gregory S. Hill, Lake Zurich, IL (US); Fred J. Kassabian, Arlington Heights, IL (US)

(73) Assignee: Dynetics Engineering Corporation, Inc., Lincolnshire, IL (US)

( * ) Notice: Subject to any disclaimer, the term of this patent is extended or adjusted under 35 U.S.C. 154(b) by 0 days.

(21) Appl. No.: 09/814,922

(22) Filed: Mar. 22, 2001

(65) Prior Publication Data

US 2003/0090049 A1 May 15, 2003

Related U.S. Application Data

(63) Continuation-in-part of application No. PCT/US01/06126, filed on Feb. 22, 2001.

(60) Provisional application No. 60/184,443, filed on Feb. 23, 2000.

(51) Int. Cl.[7] ..... B65B 35/30

(52) U.S. Cl. ..... 53/541; 53/284.3; 53/503; 53/473; 53/569

(58) Field of Search ..... 53/541, 503, 473, 53/531, 540, 569, 284.3; 493/419

(56) References Cited

U.S. PATENT DOCUMENTS 1,657,595 A * 1/1928 Swift, Jr. ..... 271/212
3,744,649 A * 7/1973 Ward, Jr. ..... 414/788.7
4,384,196 A 5/1983 McCumber et al.
4,522,617 A * 6/1985 Mowry ..... 493/126
4,926,220 A * 5/1990 Matysek et al. ..... 414/789.9
4,968,023 A * 11/1990 Huggins et al. ..... 271/212
5,058,873 A 10/1991 Hewitt et al.
5,207,418 A * 5/1993 Oakes et al. ..... 271/212
5,265,731 A * 11/1993 Van de Ven ..... 209/552
5,388,815 A 2/1995 Hill et al.
5,439,344 A * 8/1995 Yoshizuka et al. ..... 414/789.1
5,509,886 A 4/1996 Hill et al.
5,899,453 A * 5/1999 Middelberg et al. ..... 271/184

* cited by examiner

*Primary Examiner*—Eugene Kim
*Assistant Examiner*—Christopher R Harmon
(74) *Attorney, Agent, or Firm*—James W Potthast; Potthast & Associates

(57) ABSTRACT

A card package production system (100) for producing card packages (115) composed of printed paper carriers (113) with matching cards (128) attached to the carriers (113) selectively outputs the card packages through a card package multi-directional distribution module (136) having a carrier transport with a primary carrier transport path extending between a package inlet (262) and a primary package outlet (144) for transporting the card packages along the primary carrier transport path. A movable stacker gate assembly (214, FIG. 7) mounted for movement between a stacking position (FIG. 26). In the stacker position, the card packages are inserted laterally through a laterally facing inlet (145) of a stacker (146) in two stages with successive pairs of card packages (115, 115') being kept in an interleaved state.

19 Claims, 10 Drawing Sheets

CARD PACKAGE PRODUCTION SYSTEM WITH CARD PACKAGE STACKER AND METHOD

CROSS-REFERENCE TO RELATED APPLICATION

This application is a continuation-in-part of PCT application PCT/US01/06126 filed Feb. 22, 2001 and entitled "Card Package Production System Having Multidirectional Card Package Distribution Module With Stacker and Reject Gate and Method" and claiming under 35 U.S.C. 119(e) the benefit of U.S. Provisional Application No. 60/184,443, filed Feb. 23, 2000, and entitled "Card Package Production System and Method", and assigned to the assignee of the present application, both of which are hereby incorporated by reference.

BACKROUND OF THE INVENTION

1. Field of the Invention

This invention generally relates to card package production systems of the type that automatically produce card packages composed of cards, such as credit cards, attached to matching carrier forms for mailing, and more particularly, to such a system with a card package output module and card package distribution methods 2. Description of the Prior Art Card package production systems that produce card packages comprised of cards, such as plastic credit or debit cards, to matching paper carriers that bear printed information including the card owner's name and address in a location for viewing through a window envelope into which the carrier packages may be ultimately inserted, or "stuffed", for mailing to the owner.

Examples of such card package production systems in which the cards are mechanically attached to the carriers are shown in U.S. patent application Ser. No. 09/081,312, filed May 19, 1998, of Bretl et al. and entitled "Card Package Production System with a Multireader Card Track and Method", and in U.S. Pat. No. 5,494,544 issued Feb. 27, 1996 to Hill et al. and entitled "Automatic Verified Embossed Card Package Production Methods"; U.S. Pat. No. 5,541,395 issued Jul. 30, 1996 to Hill et al. and entitled "Card Package Production System with Burster and Code Reader"; U.S. Pat. No. 5,388,815 issued Feb. 14, 1995 to Hill et al. and entitled, "Embossed Card Package Production System with Modular Inserters for Multiple Forms"; U.S. Pat. No. 5,509,886 issued Apr. 23, 1996 to Hill et al. for "Card Package Production System with Modular Carrier Folding Apparatus for Multiple Forms"; and U.S. Pat. No. 5,433,364 issued Jul. 18, 1995 to Hill et al. for "Card Package Production System with Burster and Carrier Verification Apparatus", all assigned to the assignee of the present invention, and all of which together with the references cited therein are hereby incorporated by reference.

In known card package production systems, the successfully completed card packages are output from the system at a single outlet slot from which they are fed to an envelope stuffing machine or a card package stacker, as may be joined to the single outlet slot. In order to switch from one to the other, the positions of the envelope stuffing machine and the card package stacker must be exchanged.

Moreover, in known systems, the card package stackers extended in a substantially horizontal direction and thus required substantial amounts of floor space.

SUMMARY OF THE INVENTION

It is therefore an object of the present invention to provide a card package production system having a multidirectional card package distribution module that provides multiple outlets for correctly prepared card packages for different purposes, or for rejection of incorrectly prepared purposes, and a method of selectively changing which outlet is used on a real-time basis during operation of the distributor.

More particularly, it is an object to provide an alternative card package stacking apparatus to the one shown in the aforementioned PCT patent application and U.S. Provisional application, which are incorporated herein by reference.

BRIEF DESCRIPTION OF THE DRAWINGS

The forgoing advantages and objectives will be described in detail and others will be made apparent in the detailed description of the best mode of practicing the present invention presently contemplated which is given below with reference to the several views of the drawing, in which:

FIG. 2 is a perspective of a card package of the type produced by the card package production system of FIG. 1 with the card attached to the carrier;

DETAILED DESCRIPTION

Figure 1:
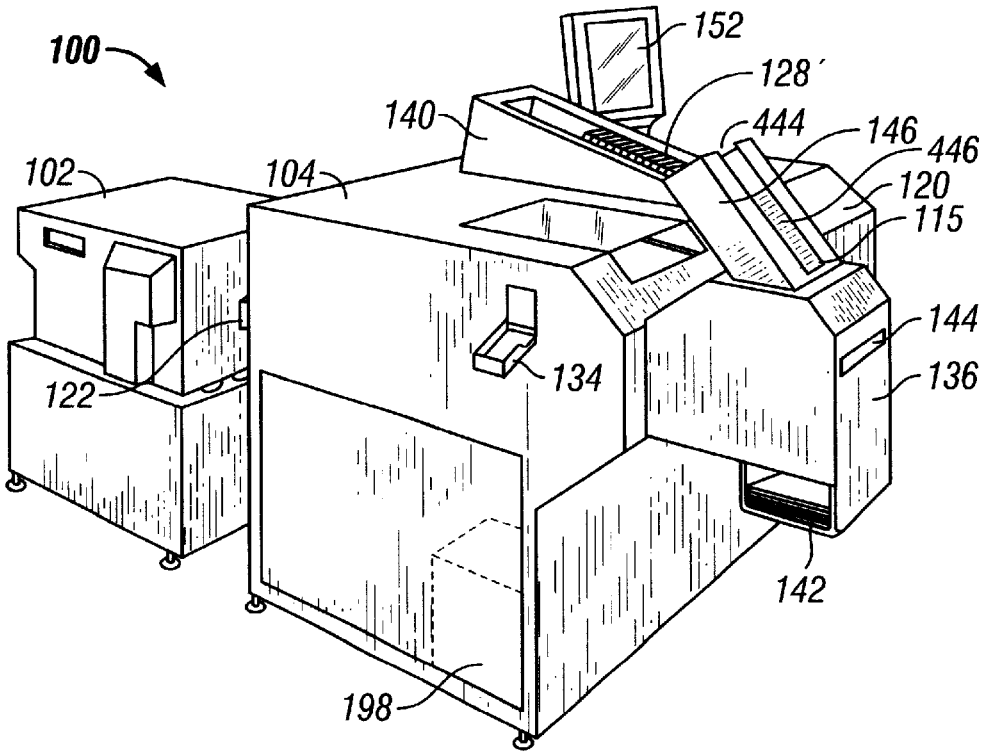
FIG. 1 is a perspective view of the card package production system of the present invention except for the stacker which is the stacker of the parent PCT application of which the present invention is an improvement.
Figure 2:
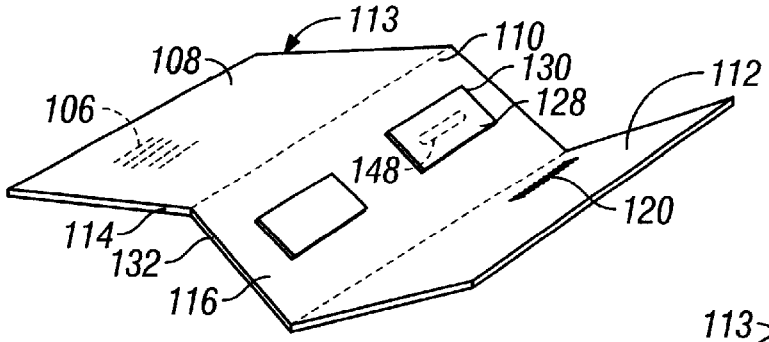
FIG. 2 is a perspective view of the card package stacking apparatus, or stacker of the present invention that is substituted for the card stacker of the card package production system of FIG. 1.

Referring to FIG. 1, the preferred embodiment of the card package production system printer 100 of the present invention is seen to include a free standing printer module 102 and a card attachment module 104. Referring to FIG. 2, the printer module prints card holder name and address and other account information 106, on one of three panels 108, 110 and 112 of a paper sheet carrier 113, such as the middle panel 110. The three panels are defined by two pre-weakened fold-lines 114 and 116. The printer module also prints a bar code 120 representative of information concerning the account on another of the panels, such as the end panel 112, such as the account number and the number of cards that are to be attached to the carrier 113. The printer module is controlled by a computer (not shown) and controller, described below. The printer preferably prints carriers at a minimum speed of 32/minute and has a resolution of no less than 300 dpi×300 dpi. The normal speed of operation is approximately 2000 carriers per hour, or approximately thirty-three carriers per minute. The printer module 102 may be a model PLAY PLEX printer made by OLYMPUS, or equivalent. The details of the printer module form no part of the present invention but reference may be made to operator's guide for the above identified model MS32NSS published by OLYMPUS.

The operation is described pursuant to the example of the card holder information 106 being located on panel 108 and the bar code 120 being mounted at the location shown on panel 112. However, the printer is capable of printing both the card holder information 106 and the bar code information 120 at other selected locations on the carrier 113. The card attachment module 104 is capable of reading the information at other informational locations on the carrier 113 than the example shown in FIG. 2.

Figure 5:
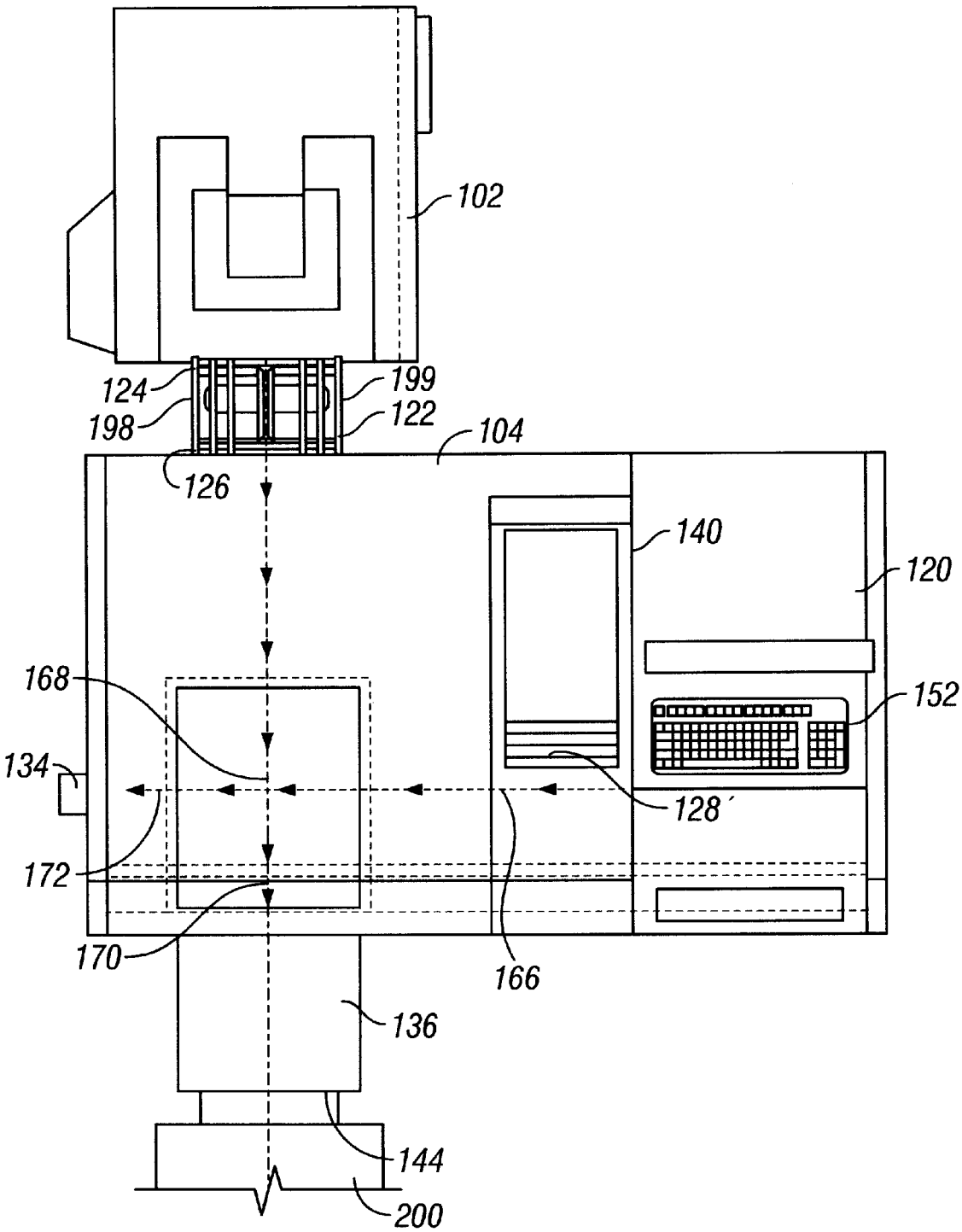
FIG. 5 is a plan view of the card package production system of FIG. 1 but with the stacker removed.

The printed carriers 113 from the printing module 102 are passed to the attachment module 104 by means of an inter-module carrier guide 122. The inter-module carrier guide is better seen in FIG. 5. Referring to FIG. 5, the guide 122 passes carriers 113 from an outlet 124 of the carrier printer module 102 to a carrier inlet 126 of the attachment module 104.

Figure 3:
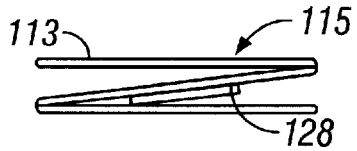
FIG. 3 is a an end view of the card package of FIG. 2 in a folded state ready for mailing.

Referring to FIGS. 1–4, the attachment module takes cards from a stack of pre-embossed cards 128' from a card picker assembly 140 and attaches the pre-embossed cards 128, such as embossed and/or magnetically encoded credit cards, encoded chip cards, R/F cards, etc. to the carrier 113 at one or more locations 130 and 132 or on like locations on one or more or all of the three panels. It then folds the carrier, as shown in FIG. 3, to form a card package 115.

The details of the card picker assembly forms no part of the present invention, and preferably is substantially the same as the one shown in U.S. patent application of Bretl et al., Ser. No. 09/081,312, filed May 19, 1998, and entitled "Card package Production System With a Multireader Card Track and Method", which is hereby incorporated by reference.

The cards 128 generally have an account number and an account holder's name embossed on the card and the same information encoded on a magnetic stripe on the back of the card 128. Additional information, such as the number of cards to be attached to the carrier may also be contained in the bar code. In addition, the back of the card has the account number and account name encoded in bar code printed on the back of the card. This information is checked for proper encoding and if the coding is not correct or if the coding does not match the encoded information of a carrier to which it is to be attached, the card 128 is passed through the attachment module 104 to a card reject bin 134.

Other wise the cards 128 are attached to the matching carrier 113 to form the card package 115, and the card packages 115 are passed to a card package distribution module 136 for distribution in three different ways depending upon circumstances. In one case, if the card packages 115 are unacceptable due to having too many cards, not enough cards or cards in the wrong location, then they are passed to a card package reject bin 142. If the card package is correctly prepared and is to be passed directly along a primary card package transport path to an envelope stuffing machine (not shown), such as a model SERIES 5 envelope stuffer made by PITNEY BOEWES, then the card packages are passed directly to the envelope stuffer through a primary card package outlet 144. Otherwise, the card package 115 is passed to a FIFO card package stacker 146 to form a stack of card packages 115'. The card package stacker 146 illustrated in FIG. 1 is the one shown and described in detail in the parent application of this continuation-in-part application cited above.

Reference should be made to the parent application for any details of the operation of the card package production system 100 other than the operation of the stacker 200 and distribution module 202 of which it is a part.

Figure 4:
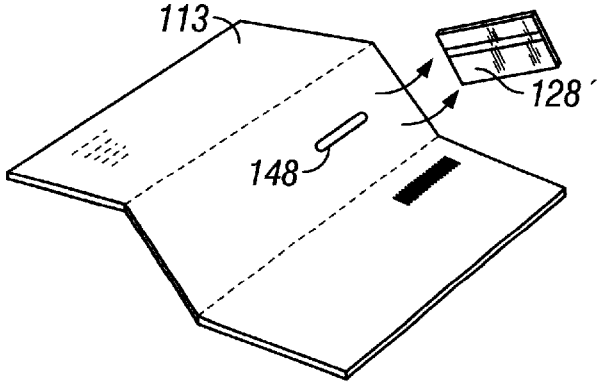
FIG. 4 is a perspective of the card package of FIG. 2 but with the card detached and showing the adhesive label remaining attached to carrier.

Referring to FIGS. 3 and 4, the card 128 is attached to the carrier 113 by means of an adhesive label 148. One side of the adhesive label 148 is attached to the card by a heat activated adhesive, such as releasable adhesive made by MAPLE ROLL, a division of ITW. The other side of the label is attached to the carrier by means of a permanent adhesive. The labels are adhered to a roll of backing paper tape by the permanent adhesive. Preferably, the adhesive labels 148 are those made by MAPLE ROLL note above, or the like.

As illustrated in FIG. 4, when the card 128 is lifted off the carrier 113, the adhesive label 148 remains attached to the carrier 113 and does not adhere to back 128' of the card 128. This is because the attraction of the permanent adhesive to the carrier 113 is stronger than the bond between the heat activated adhesive and the back of the card and, because in keeping with one aspect of the invention only a middle section of the label is heat activated to provide a "dead zone" of nonactivated adhesive at opposite ends of the label 148. Advantageously, once the heat activated label 148 is removed from the back 128' of the card 128, the heat activated adhesive losses its adhesive qualities unless it is again heated to the necessary minimum activation temperature of approximately 160-degrees Fahrenheit.

As seen in FIG. 1, the housing 104 has a flat top on which a computer display monitor 152 and a computer keyboard 154 of the computer (not shown) are supported. The computer is protectively contained within the housing section 161. The computer housing section 161 has a hinged door to enable access to the computer. Preferably, the computer that is used to control the card package production system 100 including the attachment module 104 is a model PRESARIO computer made by COMPAQ having a minimum processor speed of 333 MHZ and a minimum hard drive memory capacity of 4 GB, or the like. The computer controls all of the automatic operations of the attachment module 104 and the printer module 102, and operated the distribution module in accordance with the flow charts of FIGS. 17A and 17B.

Referring to FIG. 5, the inter-module guide 122 is aligned with a carrier transport path 164 that extends straight from the carrier inlet 126 toward the card package distribution module 136. However before the carrier reaches the card package distribution module 136, it intersects at a right angle with the card transport path 166 that extends from the card tray 140 to an intersection 168 with the carrier transport path 164. At the intersection 168, the card attachment station attaches the card or cards 128 to the carriers. The carriers with attached cards are then folded at a folding station to form card packages 115. The card packages 115 then move along a card package transport path 170 to the card package distribution module 136 and distributed according to the circumstances note above. The card transport path is elevated relative to the carrier transport path and the cards are dropped onto the carriers for attachment. If rejected and not attached, they proceed past the card attachment station along a card reject transport path 172 to the card reject bin 134.

Figure 6:
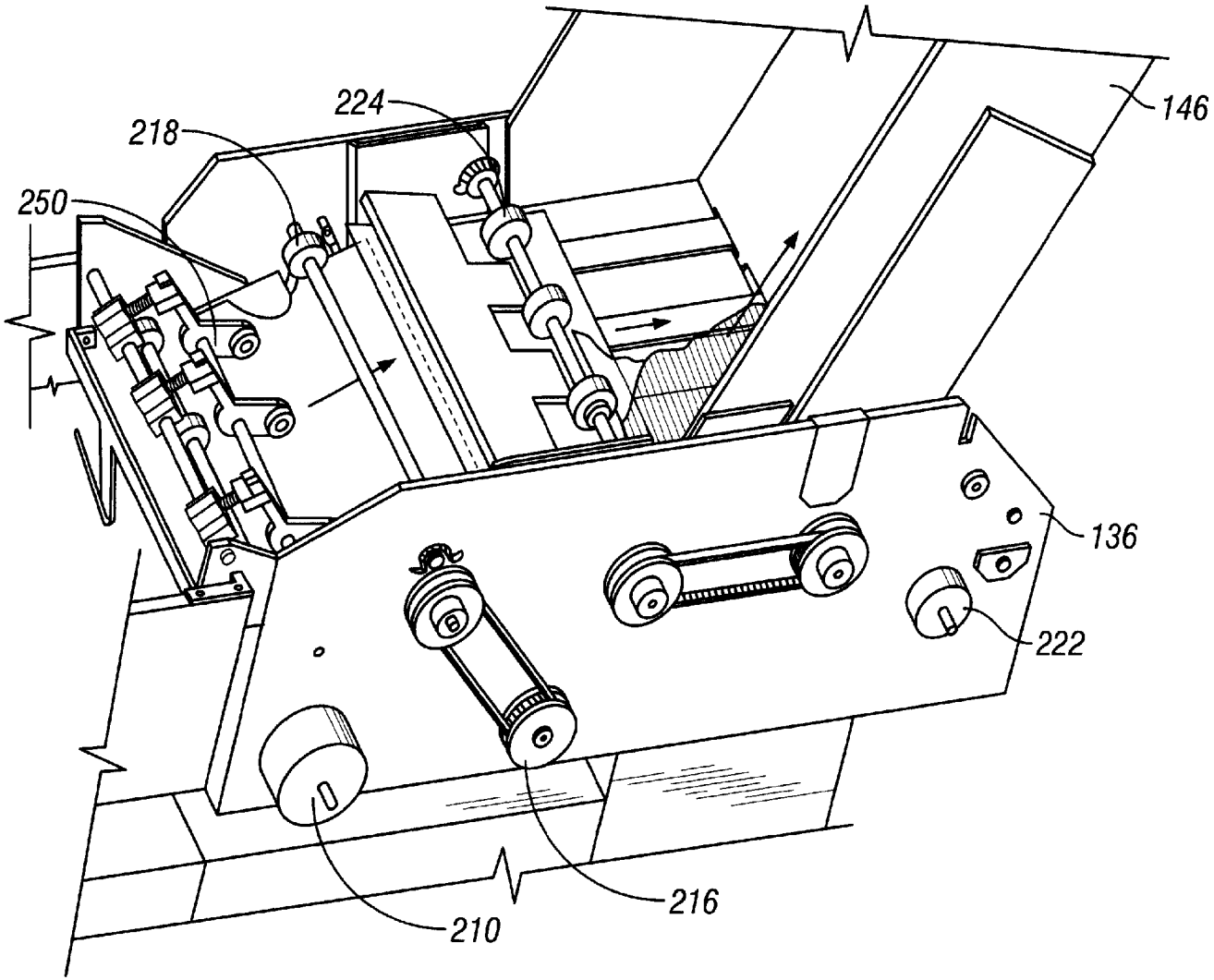
FIG. 6 is a perspective view of the card package distribution module with the stacking apparatus of the present invention that is substituted for the distribution module and stacker shown in the card package production system of FIG. 1.
Figure 7:
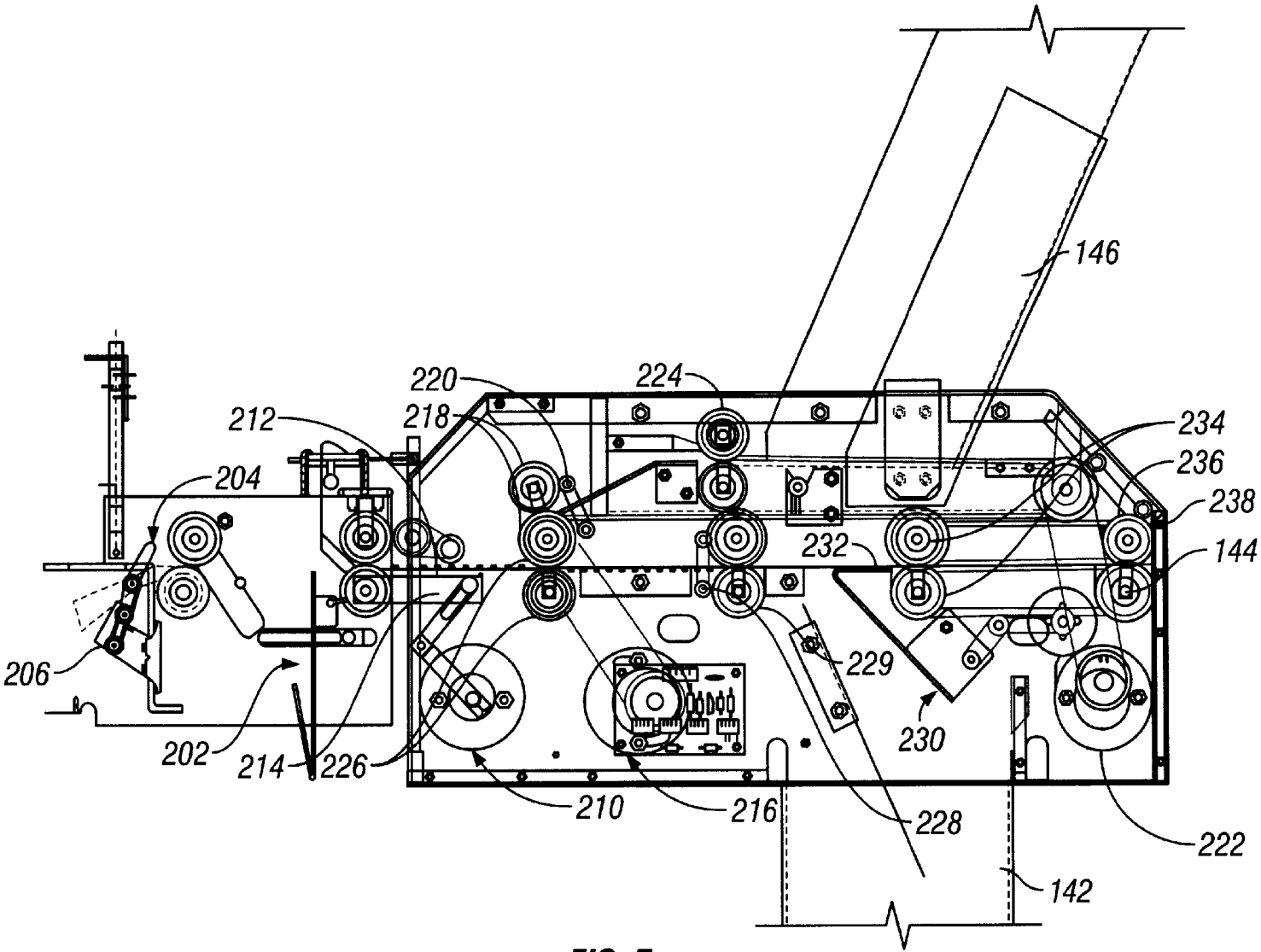
FIG. 7 is a side elevational view of the card package distribution module of which the card package stacker is a part with a side wall removed to enable a view of the interior.
Figure 8:
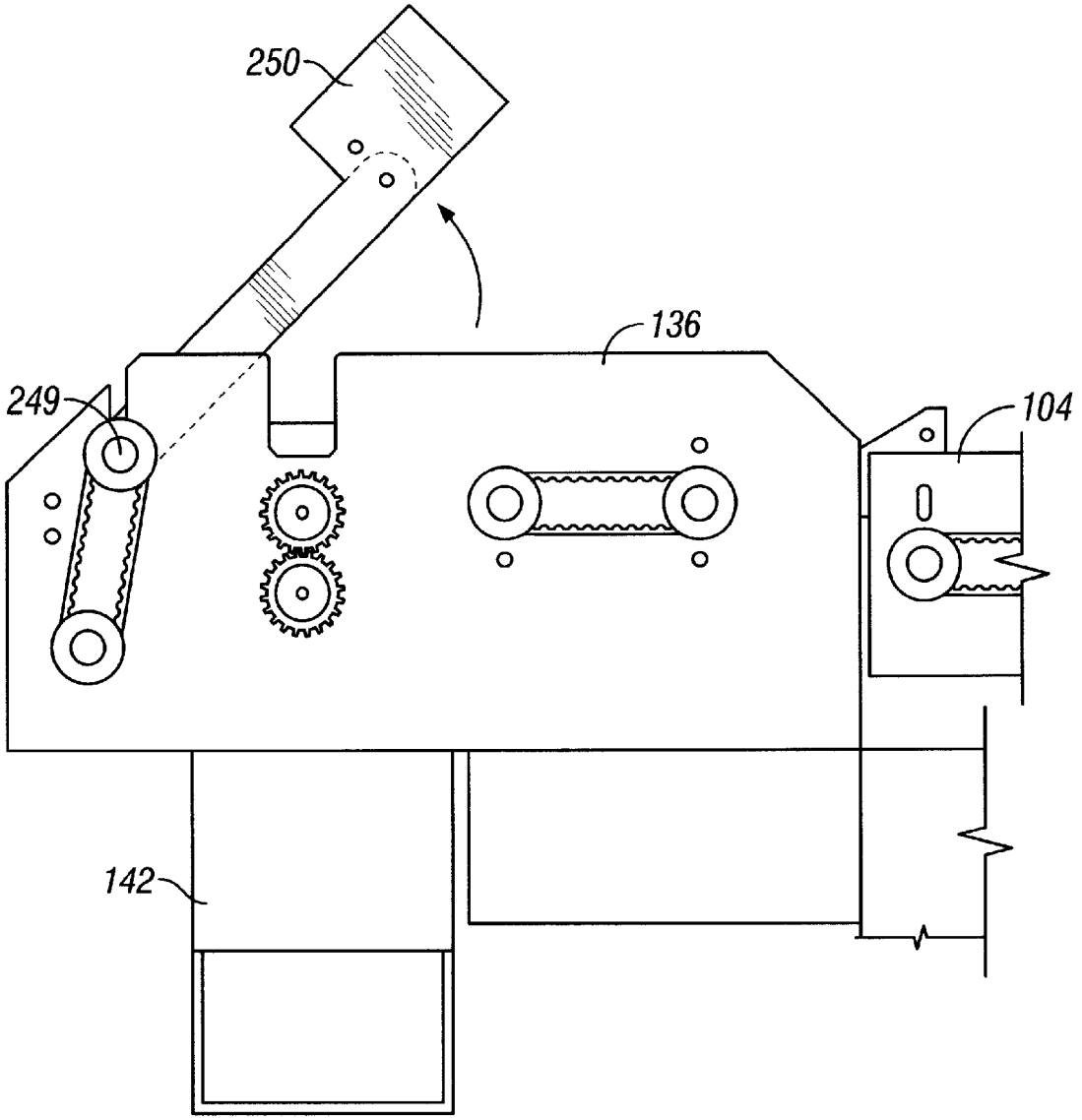
FIG. 8 is another side elevational view of another side of the card distribution module.
Figure 9:
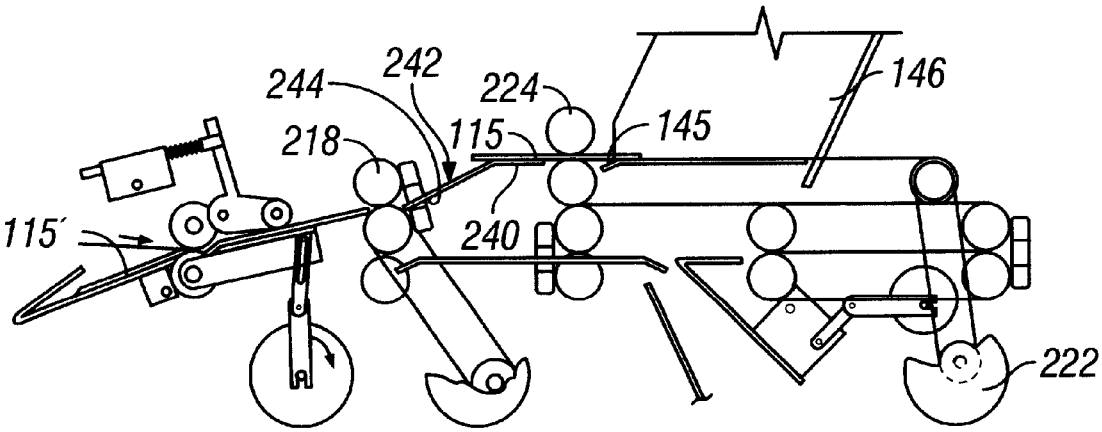
FIG. 9 is a schematic side elevational view of the card package track during a last stage of folding one carrier around a card adhered to the carrier to make the card package and in which a stacker gate is in a stack position to guide the newly formed card package to the stacker beneath an previous card package being held at a stacker loading position.
Figure 10:
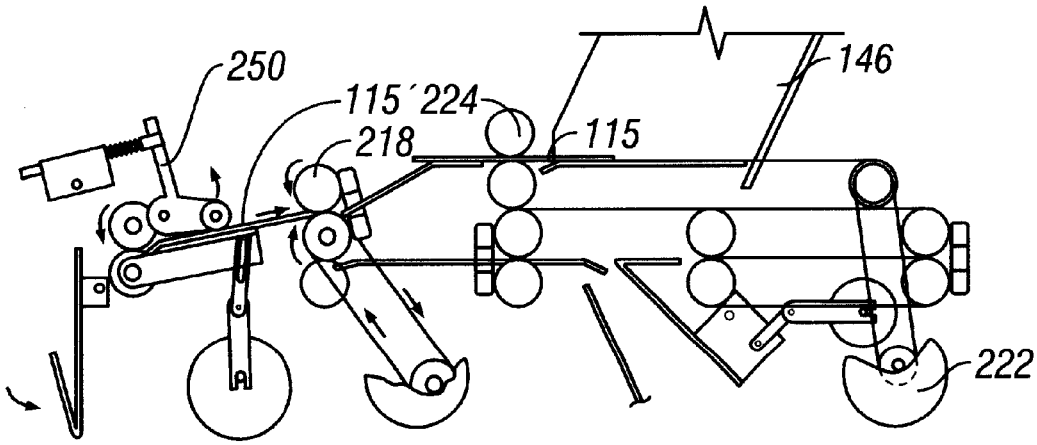
FIG. 10 is a schematic side elevational view of the card package track similar to that of FIG. 9 but when in a stage of operation in which the newly folded carrier, or card package, is being moved through a card count detection stage for final verification of the correct number of cards contained in the card package before being passed to the inlet of card package distribution module.

Referring to FIGS. 6, 7 and 8, particularly FIG. 7, as the carrier form 113 with one or more attached card 128 enters a second fold station 202 in the card package production module 104, the carrier form 113 pushes down a lever 204. A photo-sensor 206 is mounted beneath the lever 204, and when the lever 204 is in the normal, or up, position as shown in solid line in FIG. 7, light to the sensor 206 is blocked by the lever 204. However, when the lever 204 is pushed down by the carrier form 113, the light is unblocked, and the sensor 206 detects light from its associated infrared light source. The computer 198 then responds to the sensor 206 to energize the second fold drive motor. If the particular card package 115 has been identified by the computer 198 as one to be stacked rather than to be passed along the primary card package path to primary card package outlet 144 and to the envelope stuffer 200, FIG. 5, opposite the primary card package outlet 144, then simultaneously with the card package 115 being sensed and the second fold motor being turned on, the computer 196 causes the stacker solenoid 210 to be energized to pivot upwardly a stacking platform 212 of a stacking gate assembly 214 to pass the folded card package 115 to the stacker assembly 146. This position of the stacker gate assembly 214 is illustrated in FIGS. 9 and 10. In FIG. 9, a first card package 115 is in a stacker loading position in which its leading edge is protruding outwardly from a lateral facing card package receiving slot 145 at the bottom of the stacker 144 and hanging over an edge of a horizontal section 240 of a card package support member 242 having an upwardly slanted ramp section 244 while the next card package 115' is being moved into position.

Once the carrier package 115 has passed through the second fold station 202, the lever 204 is allowed to fall back down to a sensor light blocking position, and the computer 198 responds to this condition by energizing a transport motor 216 that drives the pinch rollers 218, and the card package 115 starts being pulled through the pinch rollers 218. As the card package 115 is pulled though the rollers 218, the card package 115 blocks passage of infrared light to a stacker sensor 220. When this occurs, the computer 198 responds to actuation of the sensor 220 to immediately turn on the stacker motor 222 that drives the pinch rollers 224. As the card package is pulled through the pinch rollers 224, the card package 115 passes by the stacker sensor 220. In response to this event, the computer 198 causes both of the stacker motor 222 and the transport motor 216 to turn off to remove drive from the associated pinch rollers. The first card package 115 is then left in the position shown in FIGS. 9 and 10 in which it is only partially inserted into the stacker 146.

Figure 11:
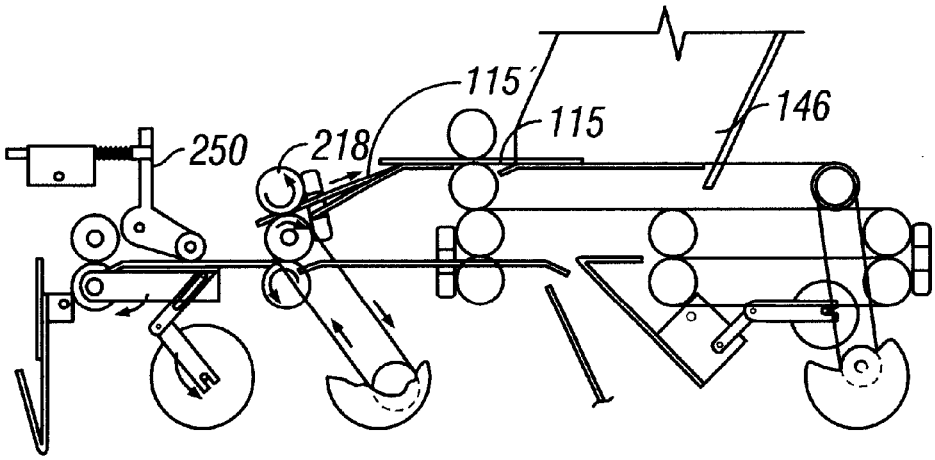
FIG. 11 is a side elevation view similar to that of FIGS. 9–10 but in which the newly formed carrier package has been received within the distributor and guided by the stacker gate to a position in which its leading edge is abutting the underside of the previous carrier being held at the stacker loading position.

As seen in FIG. 11, when the next card package 115' is driven up the ramp 242 it engages the underside of the first card package 115 adjacent the lagging edge. Then the card package 115' is advance to the position previously held by the first card package 115, and the first card package is moved entirely into the card stacker 146 and resting on the bottom 149 of the stacker 146, as shown in FIG. 12, with the leading edge 244 of the second card package 115' underlying the lagging edge 246 and being partly received within the inlet slot 145 and supported by the bottom 149 of the stacker 146.

Figure 12:
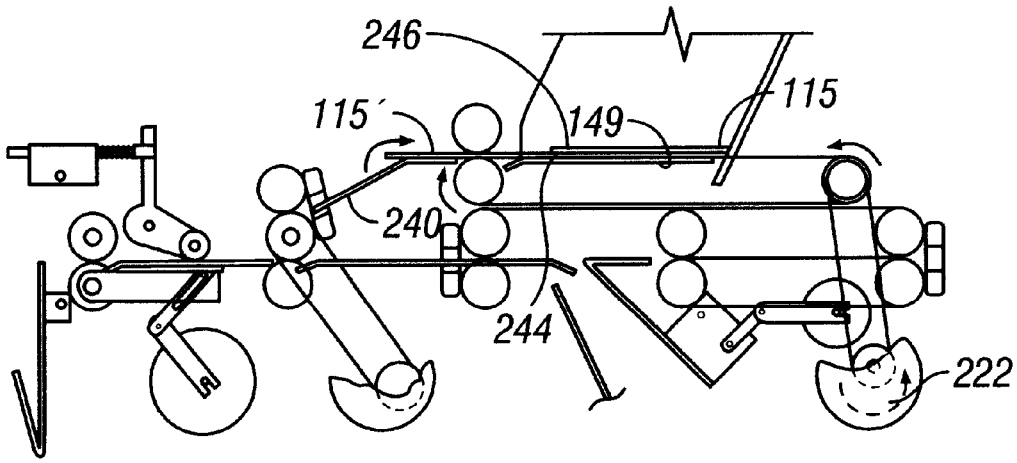
FIG. 12 is a schematic side elevation view similar to those of FIGS. 9–11 but in subsequent stage of operation in which the card package previously being held at the stacker loading station has been fully moved into the stacker and the subsequent card package has been moved to the stacker loading position previously occupied by the prior card package in which a leading edge is partly within the stacker and wedged underneath the fully loaded card package and the bottom support of the stacker.
Figure 13:
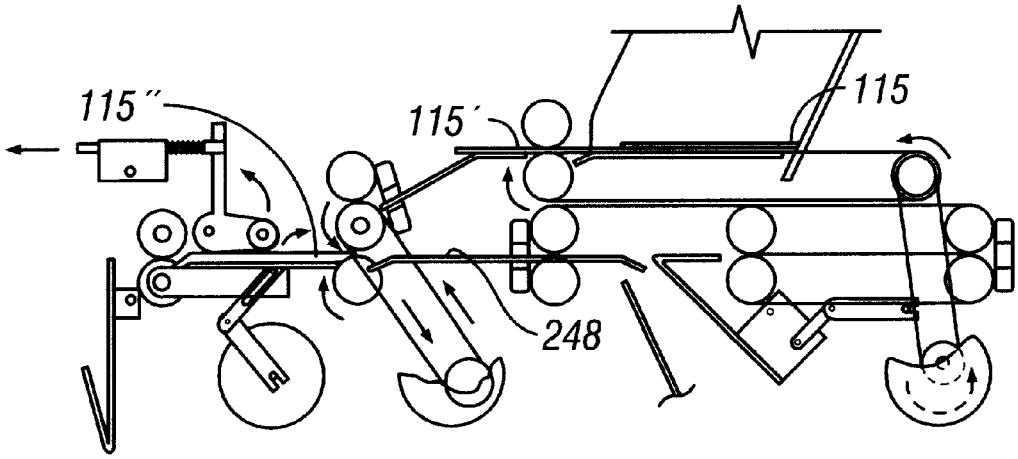
FIG. 13 is another schematic side elevation view similar to those of FIGS. 9–12 but in a stage of operation in which the stacker gate has been lowered to a non-stacking position to guide a third card package to an inlet of a primary card package path of the card package distributor instead of to the stacker.

This process is repeated for the insertion of subsequent card packages 115 with each one being interleaved with an earlier card package before being fully inserted into the card stacker, and with each earlier card package being moved fully into the card stacker at the same time a subsequent card package is being moved into the card stacker loading position, as shown in FIGS. 12 and 13.

Figure 14:
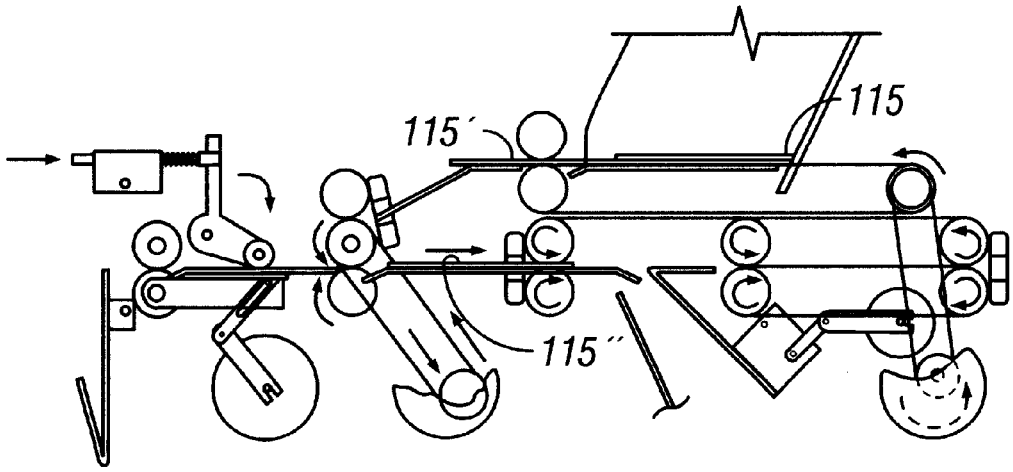
FIG. 14 is another schematic side elevation view similar to those of FIGS. 9–13 in which the third carrier package is being passed along the primary card package path shows the card package being directed away from the primary card package outlet by a reject gate and, instead, being re-directed to a card package reject bin.
Figure 15:
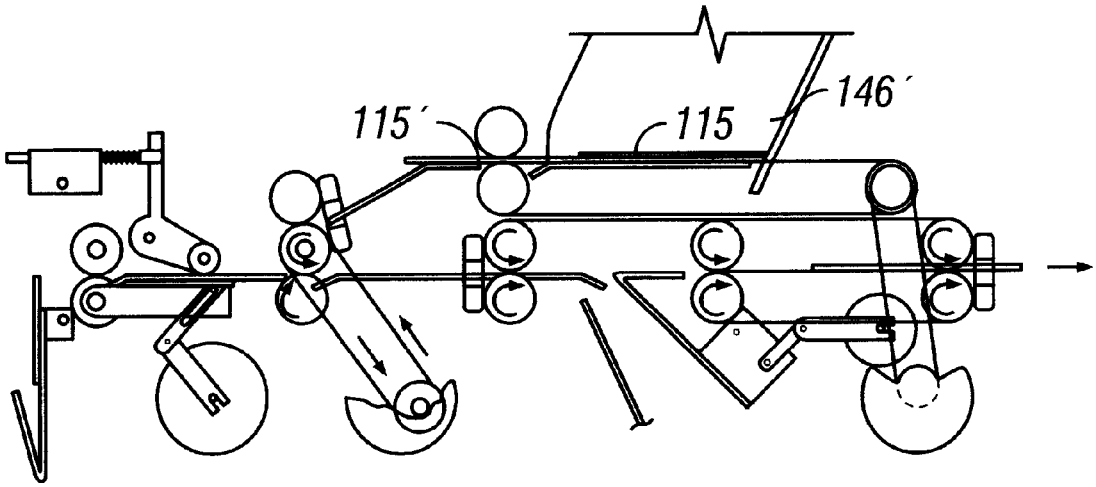
FIG. 15 is another schematic side elevation view similar to those of FIGS. 9–14 but in which the third carrier has traversed the primary card package path and is being ejected out of the primary card package outlet.

In FIG. 13, a third card package 115" has not been selected for stacking and the stacking gate has been left in it lower non-stacking position to pass the third card package to the primary card package path on support platform 248. If the card package 115" is not rejected then it passes through the series of rollers 229, 234 and 238 to the outlet 144, as shown in FIGS. 14 and 15.

If the computer 196 senses that there is something wrong with the card package 115 such that it should be rejected and not stacked, then the stacker gate solenoid 210 is not energized in response to the lever 204 being pushed down by the card package. Consequently, the card package is not directed to the stacker assembly 146 by the guide platform 212 of the stacker gate 214 that remains in a lowered non-stacking position as shown in FIG. 7. Consequently, the card package 115 passes across the platform 212 straight through to pinch rollers 226. As the card package is pulled trough the pinch rollers 226 it interrupts the light to a photo sensor 228. This causes the computer 198 to energize the reject solenoid 210 that lifts the reject platform 230 of the reject gate to be pivoted to an elevated reject position. This causes the card package to be deflected downwardly into the reject hopper 142. After a pre-selected time after the lagging edge of the card package passes the photo-sensor K, such as one-half second, the computer 198 turns off the transport motor 216.

Figure 16:
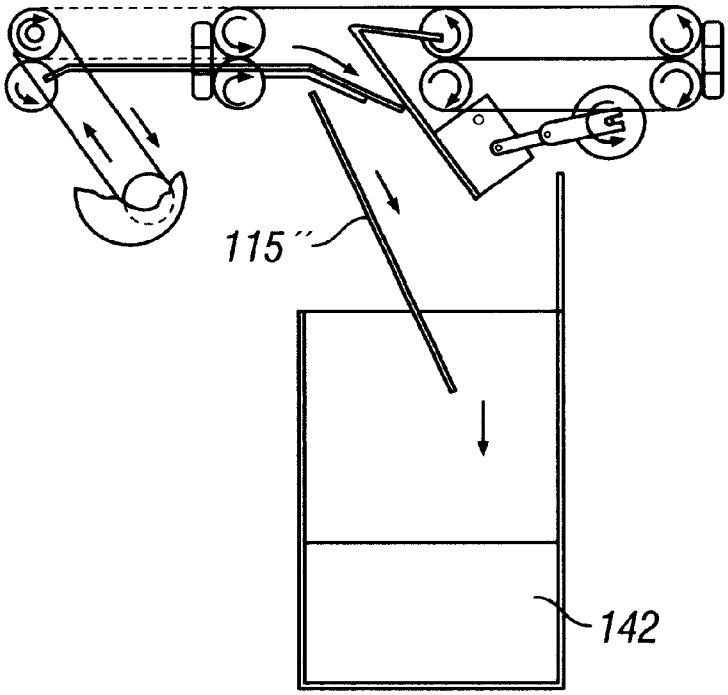
FIG. 16 is another schematic side elevation view similar to those of FIGS. 9–15 in another stage of operation in which a reject gate has been moved to a reject position to pass a fourth card package to a reject bin.

This reject operation is illustrated in FIG. 16. It should be appreciated that if a card designated for stacking is to be rejected the stacker gate remains down so that it passes through the primary card package path to reach the reject gate and the reject bin.

One of the reasons that a card package may be rejected is because the number of cards in the card package is less or more than the number of cards designated for the card package. This is determined by measuring the thickness of the card package with electronic thickness measuring gages 250, 252 and 254 that are mounted to a pivot arm 256. Normally, the gages rest on the top surface of the card packages as they pass underneath. Referring to FIG. 8, in keeping with one aspect of the invention If an envelope inserter, or stuffer, 200, FIG. 5, is employed and attached to receive card packages 115 from the primary card package outlet 144, then when a card package 115 is intended for the envelope stuffer 200, the stacking gate 214 is left in its non-stacking lowered position as shown in FIG. 7 and the card package 115, if not being rejected, is passed over the reject platform 232 and passed through a series of rollers 234 and 236 to the outlet 144. When the lagging edge of the card package 115 has cleared a sensor 238, the transport motor 222 that drives the rollers 236 and 238 is turned off. This is illustrated in FIGS. 13, 14 and 15.

The controller, or computer, 198 can be any computer capable of controlling the card attachment and distribution functions of the card package production system.

The control system preferably includes an OPTO 22 model controller system made by OPTO 22 of Temecula, Calif. and having a web site at www.optto22.com. The OPTOCONTROL system has two brain boards that interface an LCSX controller with a plurality of control modules. The control modules interface with the sensors and the control motors. The controller, in turn, operates in accordance with the OPTOCONTROL programming flow chart. Pursuant to the OPTOCONTROL, the OPTOCONTROL software automatically generates the code needed to effectuate the flow chart.

Figure 17A:
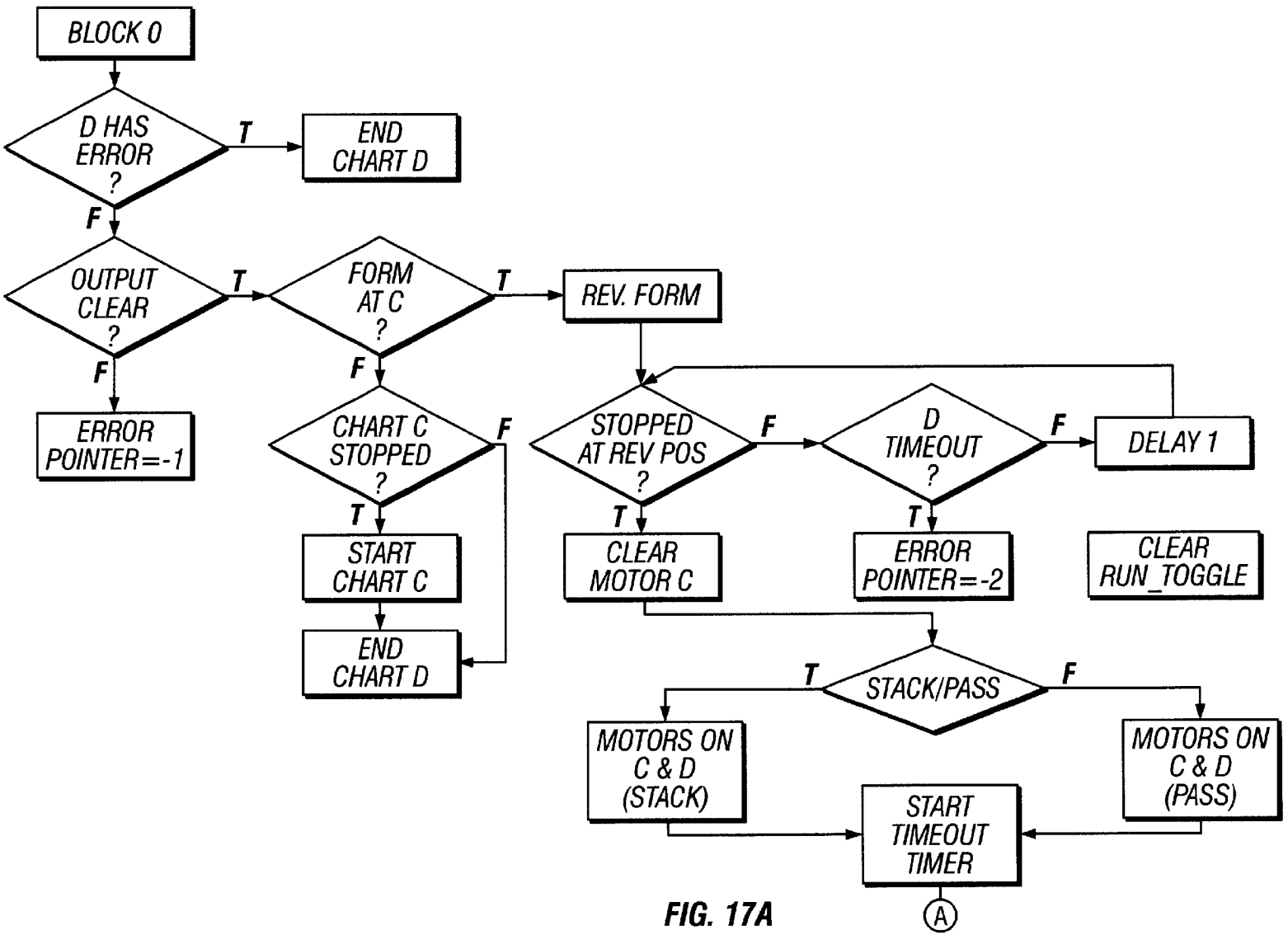
FIGS. 17A and 17B are a composite logic flow chart of the software that is used to operate the computer 198.
Figure 17B:
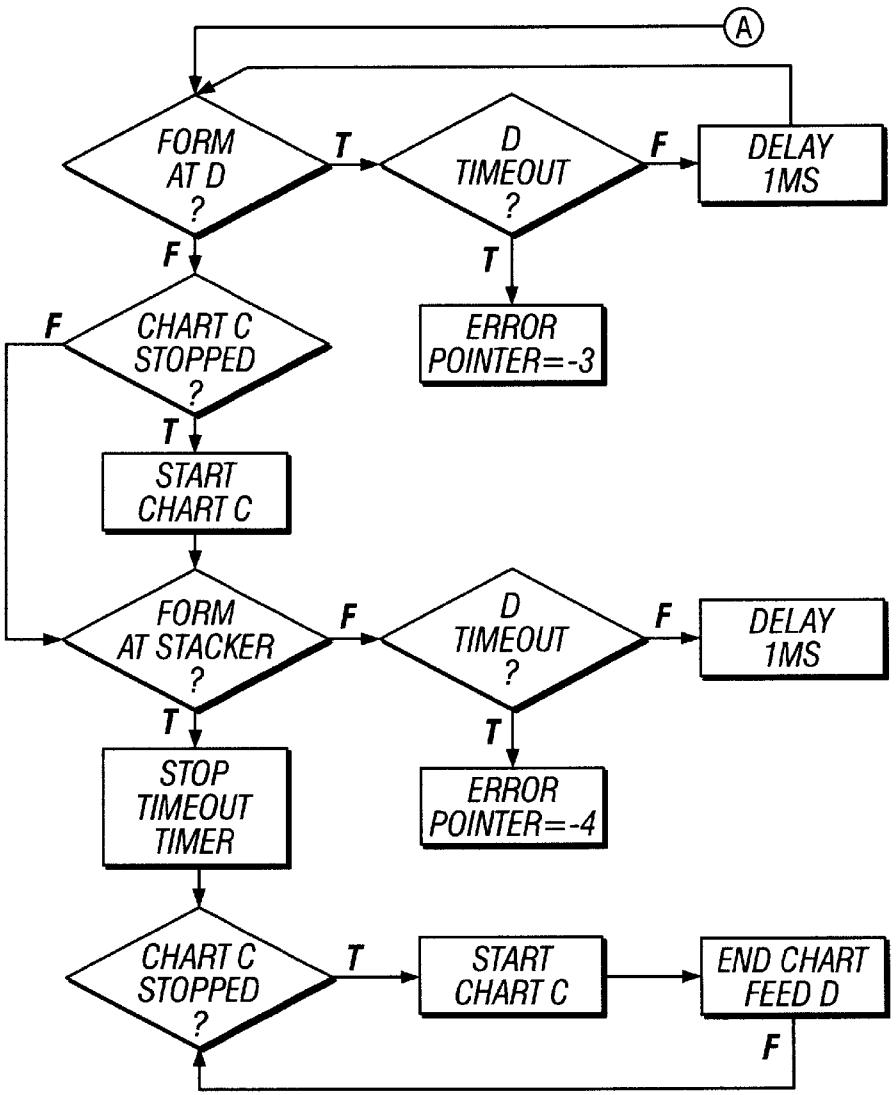

Referring now to FIGS. 17A and 17B the operational routine flow charts for operation of the distribution module and the operation of the stacker in particular are shown. The flow charts are compiled and entered into a software designer program to generate a source code used to control mechanical devices such as the preferred embodiment. The software designer program is called "OPTOCONTROL" manufactured by OPTO 22. Instructions on the use of this software and the flow chart conventions and protocol can be found in the OPTOCONTROL USER'S GUIDE, Form number 724-990831-August, 1999; the OPTODISPLAY USER'S GUIDE, Form 23-990831-August, 1999; and the OPTOCONTROL COMMAND REFERENCE, Form number 725-990831-August 1999, all of which are hereby incorporated by reference.

If other details are desired concerning the control computer 198 and the control system of which it is a part, parent of this application and the above provisional patent application on which it is based.

Referring to FIG. 8, a belt drive assembly 250 for driving the card packages 115 to the primary card package outlet is shown in a raised position to which it has been pivotally moved about pivot axis 249 for purpose of facilitating access to the carrier packages to clear a jam.

While a particular embodiment has been shown and described above, it should be appreciated that there may be many variations within the scope of the invention as defined in the appended claims.

We claim:

1. In a card package production system for producing finished card packages with printed paper carriers with matching cards attached to the carriers and having a system frame and a system housing overlying the system frame, the improvement being a stationary, finished card package stacker, comprising:

a generally rectilinear stationary stacking frame having a front and a stationary back connected to a pair of opposite sides and extending between a generally open rectangular top and a relatively closed rectangular bottom generally conforming to the shape of a stack of card packages for providing snug lateral and vertical support of a plurality of finished card packages in a an upstanding stack, open top generally conforming to the dimension and shape of the card packages to enable vertical sliding removal the open top of the stack of card packages from within the stacking frame, and said front being located opposite the back wail and having a laterally facing-inlet opening for receipt of new card packages at the bottom of the stack; and means for successively, partially inserting card packages through the laterally facing inlet opening to a card package loading position in which the card package is located between the bottom and a stack of previously fully inserted card packages but in which the card package is not fully inserted into the stacking frame and not fully aligned with the stack and has a lagging edge outside of the stacking frame;

means for successively moving the card packages to a pre-loading position in which the leading edges of card packages at the pre-loading position are beneath the lagging edges of card packages at the card package stacker loading position; and means for successively moving the card packages at the loading position that have had the leading edges inserted between the and the stack of fully inserted card packages on the bottom until the leading edge is abutted against the back and is fully inserted beneath and aligned with the stack.

2. The card package production system of claim 1 inserting means includes means for interleaving successive pairs of card packages before full insertion of either of the successive pairs of card packages into abutting relationship with the back and aligned with the stack being supported within the stacking frame into.

3. The card package production system of claim 1 in which the card packages are inserted in two stages in which, first, a leading one of two successive card packages is first moved into the stacker loading position partially inserted into the stacking frame, and, second, in which the leading one is fully inserted into the stacking fame in abutting relationship with the back and aligned with the stack while the lagging one of the two successive card packages by full insertion means as the preloading position is simultaneously moved into the stacker loading position.

4. The card package production system of claim 1 in which the insertion means includes a card package support member with a generally horizontal section aligned with the laterally facing inlet opening and a generally slanted ramp section that is joined to the horizontal section.

5. The card package of claim 4 in which the inserting means includes means for holding a card package in a stacker loading position in which the leading edge portion is received within the lateral facing input but is spaced from the back, and a lagging edge is overhanging the ramp section to enable interleaving of a subsequent card package being moved up the ramp to slide beneath the card package at the stacker loading position.

6. The card package production system of claim 1 in which the inserting means includes a pair of pinch rollers spaced outwardly from the frame for driving the card packages at the stacker loading position laterally through the facing-inlet opening to be moved along the the bottom into a fully inserted position within the frame, and another pair of pinch rollers spaced from the slanted ramp section for driving packages up the ramp sections and into interleaved relationship with a successive card package at the package loading position.

7. The card package production system of claim 1 including a stacking gate, and means for moving the stacking gate between a non-stacking position in which the finished carrier packages are guided by the gate to an alternative finished carrier transport path to carrier package outlet when in a non-stacking position, and a stacking position in which the finished card packages are guided by the gate into a stacker inlet and eventually into the laterally facing inlet opening stacker.

8. The card package production system of claim 7 in which the stacker inlet has an associated pair of stacker input rollers that are joined at a nib into which the card packages are guided by the stacker gate for transport to a stacking position.

9. The card package production system of claim 7 including a reject gate located along the finished carrier package transport path and downstream of the finished carrier package outlet for selectively guiding incorrectly prepared finished card packages to a rejected card package outlet spaced from both the stacking frame and the finished carrier package outlet.

10. The card package production system of claim 9 including means located downstream of the stacking gate for measuring the thickness of the individual ones of the card packages and means responsive to the thickness measuring means to move the reject gate.

11. The card package production system of claim 7 including a third roller in contact with a forming another nib with one of the stacker input rollers and in which the stacking gate when moved to the non-stacking position guides the card packages into the other nib for transport to the alternative finished carrier path.

12. The card package production system of claim 1 including means for measuring the thickness of individual ones of the card packages before the card packages are passed to the stacker to make sure that there are the correct number of cards in the card packages, and means for pivotally moving the measuring means out of the way for manual removal of jams.

13. The card package production system of claim 1 in which the stacking frame is at least partly oriented in a horizontal direction to lower the top relative to what the height of the top would be if the stacking frame were perfectly vertical to facilitate removal of card packages from the open top.

14. In a card package production system for producing card packages with printed paper carriers with matching cards attached to the carriers and having a frame and a housing overlying the frame, the improvement being a card package stacking method, comprising the steps of:

locating a frame for providing lateral and vertical support of a plurality of card packages in a stack having an open top out of which a stack of card packages may be removed, a closed stationary bottom for underlying support of the stack, and a laterally facing inlet opening for receipt of new card packages at the bottom of the stack in a position relative to a card package transport path for lateral receipt of card packages;

successively moving card packages along the card package transport path to a card package stacker loading position in which leading edges of card packages are inserted through the laterally facing inlet opening between the bottom and a stack of previously fully inserted card packages resting on the bottom but in which the card package is not fully inserted into the frame and not fully aligned with the stack and has a lagging edge outside of the stacking frame;

successively moving the card packages to a pre-loading position in which the leading edges of card packages at the pre-loading position are beneath the lagging edges of card packages at the card package stacker loading position; and successively moving a card package at the pre-loading position to the card package stacker loading position while simultaneously moving a card package at the card package stacker loading position into full insertion within the stacking frame and in full alignment with the stack of card packages stacked within the card package stacking frame that.

15. The method of claim 14 in which the the step of moving card packages along the card package transport path to a card package stacker loading position includes the step of moving the card packages along a generally horizontal section of a card package transport path, and the step of successively moving the card packages to a pre-loading position in which the leading edges of card packages at the pre-loading position are beneath the lagging edges of card packages at the card package stacker loading position is performed by moving the card packages along an upwardly slanted section of the card package transport path that is joined to the substantially horizontal section of the card package transport path.

16. The method of claim 15 including the steps of holding a card package in the stacker loading position in which the leading edge portion is received within the lateral facing input and the lagging edge is overhanging the upwardly slanted section to enable interleaving of a subsequent card package being moved up the upwardly slanted section to slide beneath the card package at the stacker loading position, and then moving the subsequent card package up the upwardly slanted section and sliding it beneath the lagging edge of the card package at the stacker loading position.

17. The method of claim 14 including the step of moving a stacking gate between a non-stacking position in which both correctly finished carrier packages and incorrectly finished carrier packages are guided by the gate along an alternative carrier transport path to one of a correctly finished carrier package outlet and a rejected carrier package outlet, and a stacking position in which correctly finished card packages are directed off of the alternative path and into the stacker.

18. The method of claim 17 including the step of selectively moving a reject gate located along the alternative path between a reject position in which card packages are passed to a rejected packages outlet, and an accept position in which the card packages are permitted to continue down the alternative path to the correctly finished card package outlet.

19. The method of claim 18 including the step of measuring the thickness of the card packages prior to passage of the card packages to the alternative path to determine whether they are carrying a correct number of cards and controlling the reject gate to open when a card package having an incorrect number of cards is passing by to pass the card package to the rejected packages outlet.

* * * * *